United States Patent [19]

Long et al.

[11] 4,252,633

[45] Feb. 24, 1981

[54] COAL LIQUEFACTION PROCESS

[75] Inventors: Robert B. Long, Atlantic Highlands; Martin L. Gorbaty, Westfield; Richard H. Schlosberg, New Providence, all of N.J.

[73] Assignee: Exxon Research & Engineering Co., Florham Park, N.J.

[21] Appl. No.: 935,569

[22] Filed: Aug. 21, 1978

[51] Int. Cl.[3] ..... C10G 1/00; C10G 1/06; C10B 57/08; C10B 53/00

[52] U.S. Cl. ..... 208/8 LE; 208/8 R; 208/10; 201/9; 201/23

[58] Field of Search ..... 208/8 LE, 8 R, 10; 201/9, 23

[56] References Cited

U.S. PATENT DOCUMENTS

| | | | |
|---|---|---|---|
| 2,166,321 | 7/1939 | Pott | 208/8 LE |
| 3,692,662 | 9/1972 | Wilson et al. | 208/8 LE |
| 3,791,957 | 2/1974 | Wolk | 208/10 |
| 3,970,541 | 7/1976 | William et al. | 208/8 LE |
| 3,997,424 | 12/1976 | Urquhart | 208/8 R |
| 4,019,975 | 4/1977 | Urquhart | 208/10 |
| 4,036,730 | 7/1977 | Brink et al. | 208/8 LE |
| 4,036,731 | 7/1977 | Martin | 208/8 LE |
| 4,075,079 | 2/1978 | Lang | 208/8 LE |
| 4,082,643 | 4/1978 | Gotsis et al. | 208/8 LE |
| 4,090,942 | 5/1978 | Reuther et al. | 208/8 R |

*Primary Examiner*—Delbert E. Gantz
*Assistant Examiner*—William G. Wright
*Attorney, Agent, or Firm*—Marthe L. Gibbons

[57] ABSTRACT

An integrated coal pretreatment, liquefaction and gasification process is provided in which particulate coal is contacted with a vapor phase hydrogen donor solvent to swell the coal particles. The swollen coal particles are subjected to coal liquefaction conditions at relatively low temperatures. The solid residue of the coal liquefaction stage is subjected to pyrolysis conditions at relatively high temperatures to produce an additional amount of hydrocarbonaceous oil. The solid residue of the pyrolysis stage is gasified by treatment with steam and a molecular oxygen-containing gas to produce a hydrogen-containing gas.

14 Claims, 1 Drawing Figure

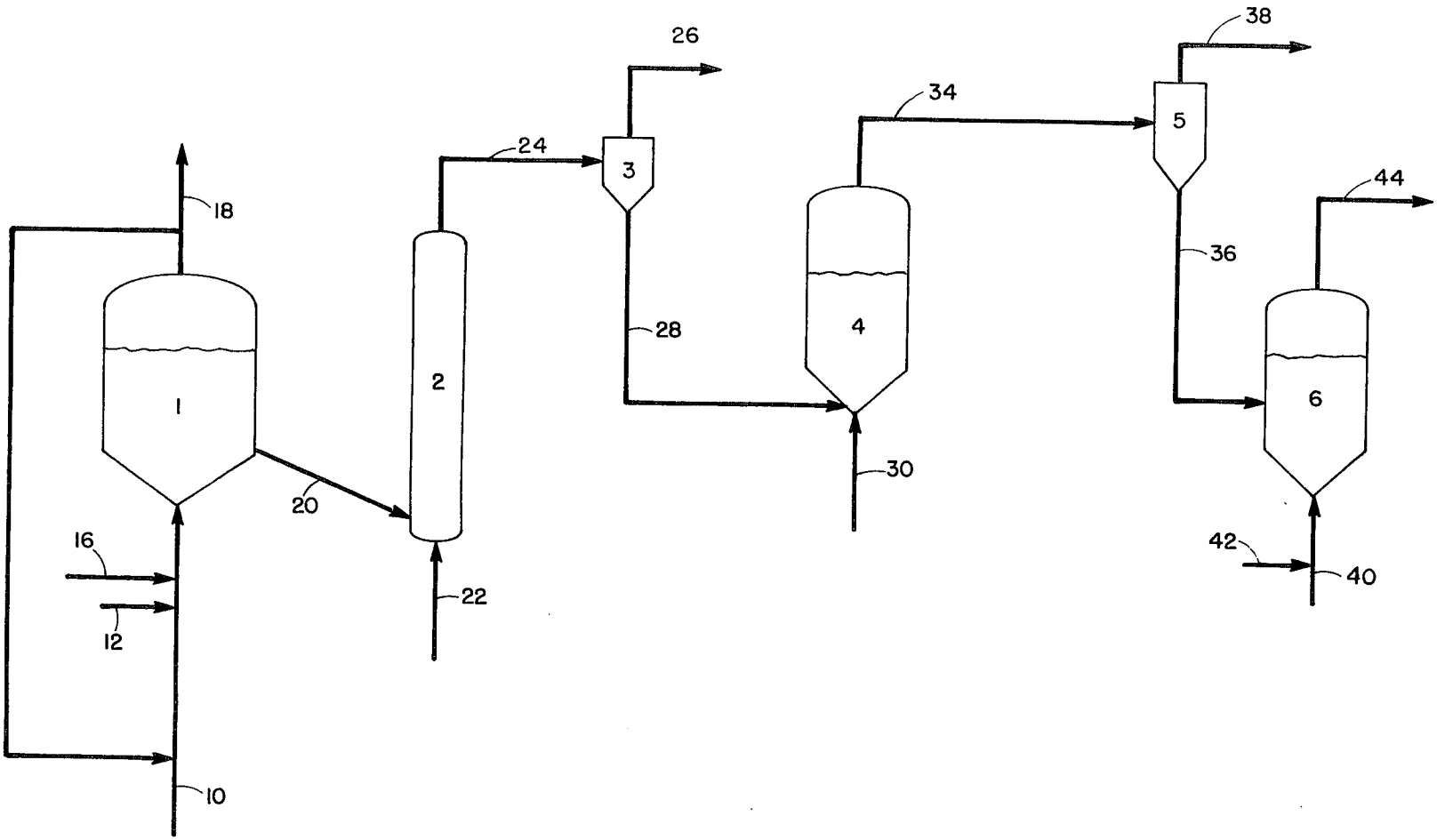
1
2
3
4
5
6
10
12
16
18
20
22
24
26
28
30
34
36
38
40
42
44

COAL LIQUEFACTION PROCESS

BACKGROUND OF THE INVENTION

1. Field of the Invention

The present invention relates to an integrated coal liquefaction and gasification process.

2. Description of the Prior Art

Coal liquefaction processes in which coal with or without a diluent is subjected to elevated temperatures and pressures to convert the coal to normally liquid hydrocarbonaceous products are well known. Coal liquefaction processes in which coal is converted in the presence of a hydrogen donor diluent with or without added molecular hydrogen are also known. See, for example, U.S. Pat. No. 3,841,991, the teachings of which are hereby incorporated by reference.

It is also known to liquefy coal in the presence of a vapor phase solvent which comprises a hydrogen donor, see for example, U.S. Pat. No. 3,997,424 and U.S. Pat. No. 4,036,731.

U.S. Pat. No. 3,692,662 discloses a staged coal liquefaction process in which a slurry of coal in a solvent, such as a hydrogen donor solvent, is maintained at a temperature below 700° F. to effect formation of a dispersion, and thereafter, the dispersed slurry is heated to a temperature above 700° F.

U.S. Pat. No. 3,791,957 discloses a coal pretreatment at a pressure in excess of 1000 psig in the presence of added hydrogen at a temperature from 600° to 750° F. followed by catalytic ebullating bed coal hydrogenation.

U.S. Pat. No. 3,970,541 discloses a process for a gas extraction of coal. The coal and solvent are heated to 370° C. at a rate of 20° C. per minute and, thereafter, to 400°–500° C. at a rate less than 10° C. per minute. The solvent is preferably in the gas phase over the greater part of the range in which the slower rate of heating is performed.

It is also known to produce liquid hydrocarbons by a fluid coking process in which coal particles are slurried in a hydrogen donor solvent as disclosed in U.S. Pat. No. 3,841,991. Fluid coking of coal in a water slurry is also known. See, for example, U.S. Pat. No. 3,272,720.

It is also known to gasify solid carbonaceous materials by treatment with steam and an oxygen-containing gas under gasification conditions to produce a hydrogen-containing gas.

It has now been found that an integrated coal preswelling, coal liquefaction and gasification process results in advantages that will become apparent in the ensuing description.

SUMMARY OF THE INVENTION

In accordance with the invention there is provided in a coal liquefaction process wherein particulate coal is converted to a hydrocarbonaceous oil in the absence of a liquid phase solvent under coal liquefaction conditions, the improvement which comprises: (a) contacting said particulate coal with a vapor phase hydrogen donor solvent at a temperature ranging from about 150° to about 350° C. and at a pressure ranging from about 10 to about 150 psig, for a time sufficient for said coal to sorb at least a portion of said solvent and thereby swell and increase in weight by at least 3 weight percent; (b) subjecting the resulting swollen coal to coal liquefaction conditions in the absence of a liquid phase solvent for a time sufficient to convert at least a portion of said coal to a normally liquid hydrocarbonaceous oil; (c) separating the effluent resulting from said coal liquefaction zone into a first vapor phase product and a first solid residue; (d) treating at least a portion of said first solid residue in a pyrolysis zone to produce an additional amount of a hydrocarbonaceous oil; (e) separating the effluent resulting from said pyrolysis zone into a second vapor phase product and a second solid residue; (f) contacting at least a portion of said second solid residue with steam and an oxygen-containing gas in a gasification zone under gasification conditions to produce a hydrogen-containing gas.

The term "coal" is used herein to designate a normally solid carbonaceous material including all ranks of coal, such as anthracite coal, bituminous coal, semibituminous coal, sub-bituminous coal, lignite, peat and mixtures thereof.

BRIEF DESCRIPTION OF THE DRAWING

The FIGURE is a schematic flow plan of one embodiment of the invention.

DETAILED DESCRIPTION OF THE INVENTION

PRETREATMENT STAGE

Particulate coal is contacted with a vapor phase hydrogen donor solvent at a temperature below coal liquefaction temperature, generally at a temperature ranging from about 150° C. to about 350° C., preferably at a temperature ranging from about 204° to about 350° C., more preferably at a temperature ranging from about 204° to about 250° C. and at a pressure ranging from about 10 to about 150 psig for a time sufficient for the coal to sorb at least a portion of the solvent and to become swollen, that is, the size of the coal will increase at least about 3 weight percent. Generally, the coal particles will be treated for a time sufficient to increase the weight of the coal from about 3 to about 50 weight percent, preferably from about 5 to about 50 weight percent relative to the initial untreated coal. Suitable contacting time will generally range from about 10 to about 100 minutes.

The vapor phase hydrogen donor solvents useful in the practice of the present invention, defined in terms of hydrogen donor potential are hydrogen donor solvents which contain at least 0.8 weight percent, preferably 1.2 to 3 weight percent donatable hydrogen based on the weight of the solvent. The hydrogen donor solvent may be any of the known hydrogen donor solvents. The hydrogen donor solvent will typically be an intermediate stream boiling at atmospheric pressure between 350° F. and about 800° F., preferably between 400° F. and about 700° F. derived from a coal liquefaction reaction. This stream contains hydrogenated aromatics, naphthenic hydrocarbons, phenolic materials and similar compounds that will normally contain at least 30 weight percent, preferably at least 50 weight percent of compounds which are known to be hydrogen donor under the temperature and pressure conditions employed in the coal liquefaction zone. Other hydrogen-rich solvents may be used instead or in addition to such coal derived liquids, particularly on initial startup of the process. Suitable hydrogen donor compounds added to or originally present in the hydrogen donor solvent include indane, $C_{10}$ to $C_{12}$ tetralins, decalins, hydrogenated methylnaphthalene, hydrogenated dimethylnaphthalene, hydrogenated $C_{12}$ and $C_{13}$ acenaphthenes, partially hydrogenated quinolines and similar donor compounds. Suitable solvent to coal weight ratio for use in the pretreatment stage include a weight ratio ranging from about 0.05 part solvent:one part coal to one part solvent:one part coal.

After the coal particles and vapor phase solvent have been in contact for a time sufficient to swell the coal particles to a desired extent, the swollen coal particles are subjected to coal liquefaction conditions. If desired, the entire effluent of the coal pretreatment stage can be passed to a coal liquefaction zone.

COAL LIQUEFACTION STAGE

The coal liquefaction zone of the present invention is operated at relatively low temperatures. In accordance with the process of the present invention, the coal liquefaction reaction is conducted in the absence of a liquid phase solvent. If desired, a gas containing molecular hydrogen may be introduced into the coal liquefaction zone directly or indirectly, that is, by adding a molecular hydrogen-containing gas to the coal pretreatment zone and subsequently introducing the entire pretreatment zone effluent comprising the molecular hydrogen-containing gas into the coal liquefaction zone.

Suitable coal liquefaction conditions include a temperature ranging from about 371° C. to about 454° C., preferably a temperature ranging from about 398° C. to below 454° C. and a pressure ranging from about 0 to about 3,000 psig, preferably from about 10 to about 150 psig. Suitable reaction time in a coal liquefaction zone include from less than 1 minute to about 2 hours, preferably from about 5 to about 90 minutes.

The coal liquefaction reaction is conducted for a time sufficient to convert coal to the desired amount of hydrocarbonaceous normally liquid oil product. By "normally liquid" is intended herein that the product is liquid at atmospheric pressure and ambient temperature.

When the coal liquefaction reaction is conducted in the presence of added molecular hydrogen, suitable hydrogen partial pressure may range from about 10 psig to about 3000 psig, preferably from about 10 to about 150 psig. The effluent of the coal liquefaction zone comprises a solid residue (char plus unconverted coal plus ash) and a vapor phase product which includes gases and a normally liquid hydrocarbonaceous oil product. The effluent may be passed through a separation zone. The solids may be separated by conventional means from the vapor phase product.

PYROLYSIS STAGE

The solid residue recovered from the coal liquefaction effluent is passed to a pyrolysis stage maintained at a relatively high temperature, suitably at a temperature ranging from about 454° C. to about 760° C., preferably from about 510° C. to about 648° C. and at a pressure ranging from about 10 to about 300 psig, preferably from about 10 to about 150 psig, for a time sufficient to produce an additional amount of a hydrocarbonaceous oil (coal liquids). The pyrolysis stage effluent is separated into a vapor phase product and a solid residue (char).

GASIFICATION STAGE

The solid residue recovered from the high temperature pyrolysis stage (i.e., second coal liquefaction stage) is passed to a gasification zone in which it is contacted with steam and a molecular oxygen-containing gas such as air, commercial oxygen or air enriched with oxygen at a temperature ranging from about 760° C. to about 1093° C., preferably from about 926° C. to about 1037° C. and at a pressure ranging from about 10 to about 150 psig to produce a hydrogen-containing gas.

DESCRIPTION OF THE PREFERRED EMBODIMENT

The preferred embodiment will be described with reference to the accompanying figure.

Referring to the figure, a vaporized hydrogen donor solvent, for example tetralin, is introduced by line 10 into vessel 1 which contains a fluidized bed of coal having an upper level indicated at 14. The coal particles in the bed will generally be particles ranging from about 40 to about 1,000 microns in size. Additional coal particles are introduced into solvent line 10 via line 12. The vaporized tetralin is introduced into vessel 1 at a velocity sufficient to maintain the coal particles in a fluidized state, for example, a superficial fluidizing velocity in the range from about 0.5 to 5 feet per second. In vessel 1, the pretreatment stage of the present invention is carried out. The fluidized bed coal pretreatment zone is maintained at a temperature ranging from about 150° C. to about 350° C. and at a pressure ranging from about 10 to about 150 psig. The coal particles are maintained in fluidized state by the flow of vapor phase solvent through the bed of coal. If desired, a molecular hydrogen-containing gas may also be introduced into vessel 1 by injecting the gas into line 10 via line 16. The hydrogen-containing gas may be substantially pure hydrogen or a gaseous mixture containing other gases such as off gases from reforming processes, etc. The coal and vapor phase tetralin are contacted in vessel 1 for a period of time sufficient for the coal particles to sorb a portion of the vaporous tetralin and become swollen coal particles. The coal is sufficiently swollen when it has increased in weight by about 3 to about 50 percent relative to the initial weight of the coal. The initial particle size of the coal prior to treatment with the solvent will generally range from about 0.01 to about 0.25 inches in diameter, preferably from about 0.05 to about 0.13 inches in diameter. Suitable residence time in vessel 1 includes from about 10 minutes to about 100 minutes. A portion of the vapors of vessel 1 is removed overhead via line 18. The overhead comprises the solvent. If desired, the solvent may be fractionated by conventional means and at least a portion thereof may be recycled to vessel 1. Furthermore, the solvent may be hydrogenated in a conventional way to improve its hydrogen donor properties. A stream of swollen coal particles is removed via line 20 and introduced into transferline pyrolysis reactor 2. A hot carrier gas is introduced into reactor 2 via line 22. The carrier gas may be a molecular hydrogen-containing gas and/or additional vaporized hydrogen donor solvent. In the transferline pyrolysis reactor, the swollen coal is converted to normally liquid hydrocarbonaceous oil and a solid residue. That is, the first coal liquefaction stage is conducted in this preferred embodiment in the transferline pyrolysis reactor. It should be noted that the coal liquefaction should be conducted in the absence of any added liquid solvent. Suitable transferline temperatures include from about 371° C. to about 454° C. and a pressure ranging from about 10 to about 150 psig.

The vaporous effluent of the transferline reactor comprises normally liquid hydrocarbonaceous oil, gases and a solid residue. The effluent is passed via line 24 to a separation zone 3 in which the solid residue including char is removed from the vapor phase products. The vapor phase products are removed from separation zone 3 by line 26. The separated solid residue is removed by line 28 and passed to pyrolysis vessel 4.

In vessel 4, the solid residue of the coal liquefaction stage is maintained in a pyrolysis zone operated at a temperature ranging from about 454° C. to about 760° C., preferably from about 510° C. to about 648° C. and at a pressure ranging from about 10 to about 300 psig, preferably from about 10 to about 150 psig. The high temperature pyrolysis zone is a second liquefaction stage since it is operated to produce an additional amount of hydrocarbonaceous oil. Suitable fluidizing gases for introduction into the high temperature pyrolysis zone via line 30 include inert gases such as nitrogen, a hydrogen-containing gas, vaporized solvent, vaporized hydrogen donor solvent and mixtures thereof. The effluent of vessel 4 comprises a vaporous product including normally liquid hydrocarbonaceous oil and solids. The effluent is removed via line 34 and passed to a separation zone 5. The vapor phase product is removed from separation zone 5 by line 38. The solid residue is removed from separation zone 5 by line 36 and passed to a gasification vessel 6. Vessel 6 is operated as a fluidized bed gasification zone in which the solid residue of the pyrolysis stage of vessel 4 is fluidized by gases introduced into vessel 6. The gasification zone is maintained at a temperature ranging from about 760° C. to about 1093° C., preferably at a temperature ranging from about 926° C. to about 1037° C. and a pressure ranging from about 10 to about 150 psig. A molecular oxygen-containing gas such as air, commercial oxygen or air enriched with oxygen is introduced into gasification vessel 6 via line 40. Steam is introduced into line 40 via line 42. The mixture of steam and oxygen-containing gas fluidizes the solid residue (char) and reacts with the char to produce a hydrogen-containing gas. If desired, the effluent of the gasification zone is recovered via line 44. The effluent comprises a hydrogen-containing gas. The hydrogen-containing gas may be used as such or scrubbed in a conventional way. If desired, at least a portion of the hydrogen-containing gas may be recycled to transferline reactor 2 or to vessel 4 with or without prior removal of any solid fines. The following examples are presented to illustrate the invention.

EXAMPLE 1

The following example shows the product obtained when a solid residue resulting from a coal liquefaction conducted with a hydrogen donor solvent and hydrogen is subjected to pyrolysis conditions under nitrogen.

About 15 grams of 10–20 mesh dried coal was placed in a tubular reactor in a tube furnace and pressured to 150 psig with hydrogen. The flow of tetralin and hydrogen was then started, and the heat was turned on for the furnace. The coal was in contact with tetralin vapors and hydrogen between the temperatures of 320° and 650° F. for 60 minutes in Run 141 and 10 minutes in Run 147. This is the temperature region where tetralin is a vapor at the flow rates used but also below the appreciable liquefaction temperature.

As can be seen in Table I the yield of liquids in both runs is considerably higher than the pyrolysis yields shown in the note under Table I. Furthermore, a companion run was made at 760° F. in which the coal was heated to temperature under hydrogen and the tetralin-hydrogen mixture was fed only after the coal reached operating temperature. This is shown as Run 32 in Table I. It should be noted that both the primary liquid production and the extractable yields are greatly reduced, indicating the value of having a hydrogen donor present during the warm-up period.

The dried chars from Runs 141 and 147 were then pyrolyzed under $N_2$ at 1200° F. An additional 4 to 5% liquids was obtained to give a final total liquid plus extracts yield of 42.2 to 46.8% on feed coal.

The chars can be gasified in a conventional manner.

TABLE I

| | Tetralin/ Hydrogen | | Hydrogen/ Tetralin |
|---|---|---|---|
| Run No. | 141 | 147 | 32 |
| Temp., °F. | 750 | 800 | 760 |
| Yield, Wt. % on Dried Feed Coal | | | |
| Gas (Incl. $H_2O$) | 11.7 | 20.5 | 19.9 |
| Liquid | 26.0 | 23.9 | 8.2 |
| Cyclohexane Extract | 1.1 | 1.0 | 0.0 |
| Pyridine Extract | 15.6 | 12.2 | 8.1 |
| Total Liquid + Extract | 42.7 | 37.1 | 16.3 |

Note:
6.9% extractable from dried coal feed with pyridine
7.9% pyrolysis weight loss under $N_2$ at 750° F.
10.5% pyrolysis weight loss under $N_2$ at 800° F.

TABLE II

| Run No. | 141 | 147 |
|---|---|---|
| Temp., °F. | 750 | 800 |
| Weights, g | | |
| Starting Char | 0.66 | 1.21 |
| Final Char | 0.44 | 0.91 |
| Liquid | 0.06 | 0.15 |
| Gas (by difference) | 0.16 | 0.15 |
| Per Cents (on Starting Char) | | |
| Final Char | 67 | 75 |
| Liquid | 9 | 12 |
| Gas | 24 | 12 |
| Per Cents (on Dried Coal) | | |
| Final Char | 30.6 | 31.8 |
| Liquid (Total) | 46.8 | 42.2 |

EXAMPLE 2

A small vertical continuous flow reactor was built which would hold about 15 g. of coal. At the bottom, a boiler was installed to vaporize completely the solvent pumped to it so that the solvent vapors passed up through the granular fixed bed of 10–20 mesh Wyodak coal. The coal was held at a temperature and pressure such that none of the solvent vapors would condense as liquid on the coal. To start a run, the coal was charged to the reactor, the boiler and coal were heated to above the boiling point of the solvent, the solvent was started to the boiler, and, if desired, hydrogen flow was started also to the boiler.

A pair of runs was made using tetrahydroquinoline as solvent along with flowing hydrogen to show the effect of staging temperature vs. rapid heat-up to pyrolysis temperature of 550°–560° C. The pressure in both cases was atmospheric. In Run A the bed of coal was heated to 270° C. before solvent was started flowing and then held there for one hour. Next, it was heated to 445° C. and held there for another hour. Finally, it was heated to 550° C. and held there for one hour. In Run B the coal sample was heated rapidly to 550° C. in 20 minutes, passing through the 430° C. temperature 10 minutes after start of heating. The coal liquids were recovered by vacuum distilling off the tetrahydroquinoline from the overhead product and the total conversion was obtained by weighing the coal recovered from the reactor after the run. Thus the liquid yields shown in the table are conservative since some of the lower boiling liquid product probably distilled off with the solvent.

As can be clearly seen from Table III, the presence of hydrogen donor solvent vapors combined with staged temperature treating greatly increases both coal conversion and selectivity to liquids.

TABLE III

| Run<br>Solvent | A<br>Tetrahydro-quinoline | B<br>Tetrahydro-quinoline |
|---|---|---|
| Pretreat Temp., °C. | 270 | Heat to |
| Pretreat Time, min. | 60 | 430° C. |
| Liquid Yield, wt. % on coal | 4.5 | in 10 min. |
| First Pyrolysis Temp., °C. | 445 | To 550° C. |
| First Pyrolysis Time, min. | 60 | in 20 min. from start |
| Liquid Yield, wt. % on coal | 12.4 | 8.5 (first hr.) |
| Second Pyrolysis Temp., °C. | 550 | 560 |
| Second Pyrolysis Time, min. | 60 | 100 |
| Liquid Yield from 445 to 550° C. | 11.1 | — |
| Liquid Yield at 550° C. | 5.5 | 5.9 (2nd hr) |
| Total 243 + °C. Liquid Yield, % | 33.5 | 14.4 |
| Total Conversion, % | 59.8 | 43.0 |

What is claimed is:

1. In a coal liquefaction process wherein particulate coal is converted to a hydrocarbonaceous oil in the absence of a liquid phase solvent at coal liquefaction conditions, the improvement which comprises:

(a) contacting said particulate coal with a vapor phase hydrogen donor solvent at a temperature ranging from about 150° to about 350° C. and at a pressure ranging from about 10 to about 150 psig, for a time sufficient for said coal to sorb at least a portion of said vapor phase solvent and thereby swell and increase in weight by at least about 3 weight percent;

(b) subjecting the resulting swollen coal to coal liquefaction conditions, including a temperature ranging from about 371° to about 454° C. and a pressure ranging from about 10 to about 150 psig, in the absence of a liquid phase solvent in a coal liquefaction zone for a time sufficient to convert at least a portion of said coal to a normally liquid hydrocarbonaceous oil;

(c) separating the effluent resulting from said coal liquefaction zone into a first vapor phase product and a first solid residue;

(d) treating at least a portion consisting essentially of said first solid residue in a pyrolysis zone maintained at a higher temperature than the temperature of said coal liquefaction zone of step (b) to produce additional amounts of hydrocarbonaceous oil;

(e) separating the effluent resulting from said pyrolysis zone into a second vapor phase product and a second solid residue, and (f) contacting at least a portion of said second solid residue with steam and a molecular oxygen-containing gas in a gasification zone under gasification conditions to produce a hydrogen-containing gas.

2. The process of claim 1 wherein said coal is contacted with said solvent in step (a) for a time sufficient for said coal to increase in weight from about 3 to about 50 percent, based on the initial weight of said coal.

3. The process of claim 1 wherein said pyrolysis zone of step (d) is operated at a temperature ranging from about 454° C. to about 760° C. and at a pressure ranging from about 10 to about 300 psig.

4. The process of claim 1 wherein said particulate coal is contacted with said vapor phase solvent in step (a) for a period of time ranging from about 10 to about 100 minutes.

5. The process of claim 1 wherein in step (a) the solvent to coal weight ratio ranges from about 0.05:1 to 1:1 in said contacting step.

6. The process of claim 1 wherein said coal liquefaction of step (b) is conducted in the presence of added molecular hydrogen.

7. The process of claim 1 wherein said coal liquefaction of step (b) is conducted in the presence of added vaporized solvent.

8. The process of claim 1 wherein said coal liquefaction conditions of step (b) include a temperature ranging from about 398° C. to about 454° C.

9. The process of claim 1 wherein said particulate coal in step (a) is maintained in a fluidized bed, said vapor phase hydrogen donor solvent being the fluidizing agent.

10. The process of claim 1 wherein said temperature of step (a) ranges from about 204° to 250° C.

11. A process for converting particulate coal to a normally liquid hydrocarbonaceous oil, which comprises:

(a) contacting said coal with a vapor phase hydrogen donor solvent in a fluidized bed zone maintained in a fluidized state by a fluidizing gas comprising said vapor phase solvent, said zone being maintained at a temperature ranging from about 150° C. to about 350° C. and at a pressure ranging from about 10 to 150 psig, said contacting being for a time sufficient for said coal to sorb at least a portion of said solvent and thereby produce swollen coal and increase the weight of said coal by at least about 3 weight percent;

(b) subjecting the resulting swollen coal to coal liquefaction conditions, in the absence of a liquid phase solvent, in a coal liquefaction zone maintained at a temperature ranging from about 371° C. to about 454° C. and at a pressure ranging from about 10 to about 150 psig for a time sufficient to convert at least a portion of said coal to a normally liquid hydrocarbonaceous oil;

(c) separating the effluent resulting from said coal liquefaction zone into a first vapor phase product and a first solid residue;

(d) passing at least a portion consisting essentially of said first solid residue to a pyrolysis zone maintained at a temperature ranging from about 454° C. to about 760° C. and a pressure ranging from about 10 to about 150 psig, to produce an additional amount of normally liquid hydrocarbonaceous oil;

(e) separating the effluent of said pyrolysis zone into a second vapor phase product and a second solid residue; and (f) contacting at least a portion of said second solid residue with steam and a molecular oxygen-containing gas in a gasification zone maintained at a temperature ranging from about 760° C. to about 1093° C. to produce a hydrogen-containing gas.

12. The process of claim 11 wherein said fluidizing gas of step (a) additionally comprises molecular hydrogen.

13. The process of claim 11 wherein a molecular hydrogen-containing gas is introduced into said coal liquefaction zone of step (b).

14. The process of claim 11 wherein said temperature of step (a) ranges from about 204° to 250° C.

* * * * *